US011351568B2

(12) United States Patent
Jacobson

(10) Patent No.: US 11,351,568 B2
(45) Date of Patent: Jun. 7, 2022

(54) PAINT APPLICATOR ASSEMBLY

(71) Applicant: Nova Wildcat Shur-Line, LLC, St. Francis, WI (US)

(72) Inventor: John Jacobson, Mequon, WI (US)

(73) Assignee: Nova Wildcat Shur-Line, LLC, St. Francis, WI (US)

( * ) Notice: Subject to any disclaimer, the term of this patent is extended or adjusted under 35 U.S.C. 154(b) by 61 days.

(21) Appl. No.: 16/547,228

(22) Filed: Aug. 21, 2019

(65) Prior Publication Data

US 2021/0053090 A1 Feb. 25, 2021

(51) Int. Cl.
*B05C 17/00* (2006.01)
*B05C 17/005* (2006.01)

(52) U.S. Cl.
CPC ..... *B05C 17/00589* (2013.01)

(58) Field of Classification Search
CPC ..... B05C 17/00589; B05C 1/00; B05C 17/00
USPC ..... 15/210.1; 401/48
See application file for complete search history.

(56) References Cited

U.S. PATENT DOCUMENTS

| | | | | |
|---|---|---|---|---|
| 2,810,148 | A | 10/1957 | Wood, Jr. | |
| 3,708,821 | A | 1/1973 | Chase et al. | |
| 5,117,527 | A | 6/1992 | Milkie | |
| 5,134,745 | A * | 8/1992 | Burns | A46B 15/00 15/210.1 |
| 5,443,533 | A * | 8/1995 | Magnien | B05C 17/00 15/105 |
| 6,554,902 | B2 | 4/2003 | Yan | |
| D482,202 | S | 11/2003 | Newman et al. | |
| D504,777 | S | 5/2005 | Gartner | |
| D510,812 | S | 10/2005 | Bortz | |
| D515,821 | S | 2/2006 | Gartner | |
| D524,551 | S | 7/2006 | Gartner | |
| 7,854,037 | B2 | 12/2010 | Lu | |
| 8,032,973 | B2 | 10/2011 | Lutgen et al. | |
| D825,194 | S | 8/2018 | Katsuma | |
| 10,040,093 | B2 | 8/2018 | Fee et al. | |
| 2004/0107525 | A1 | 6/2004 | Newman et al. | |
| 2007/0003358 | A1 | 1/2007 | Futo et al. | |
| 2016/0016193 | A1* | 1/2016 | Fee | B05C 17/00 401/48 |
| 2017/0165701 | A1* | 6/2017 | Constantine | B05C 1/00 |
| 2018/0304298 | A1 | 10/2018 | Fee et al. | |

* cited by examiner

*Primary Examiner* — Katina N. Henson
(74) *Attorney, Agent, or Firm* — Michael Best & Friedrich LLP

(57) ABSTRACT

A paint edger for applying paint with a paint applicator pad that is coupled to the paint edger. The paint edger includes a frame having a base with a forward side, a rear side, a first lateral side, and a second lateral side opposite the first lateral side, the first lateral side defines a first edge. The paint edger also includes an ejection mechanism supported by the frame. The ejection mechanism defines a second edge adjacent the second lateral side of the base. The ejection mechanism includes an actuator. The actuator is operable to move the second edge relative to the frame to uncouple the paint applicator pad from the paint edger.

14 Claims, 8 Drawing Sheets

PAINT APPLICATOR ASSEMBLY

BACKGROUND

The present invention relates to a paint applicator assembly and in particular to a paint edger with an ejection mechanism.

Paint edgers are used for wall painting, such as above baseboards, below crown molding, around window and door trim, and at the juncture between two walls. A paint applicator pad is typically coupled to a paint edger to apply paint to the wall or surface. After use, a user may remove and dispose of the applicator pad.

SUMMARY

In one embodiment, the invention provides a paint edger for applying paint with a paint applicator pad that is coupled to the paint edger. The paint edger includes a frame having a base with a forward side, a rear side, a first lateral side, and a second lateral side opposite the first lateral side, the first lateral side defines a first edge. The paint edger also includes an ejection mechanism supported by the frame. The ejection mechanism defines a second edge adjacent the second lateral side of the base. The ejection mechanism includes an actuator. The actuator is operable to move the second edge relative to the frame to uncouple the paint applicator pad from the paint edger.

In another embodiment, the invention provides a paint applicator assembly including a paint edger with a frame having a base with a forward side, a rear side, a first lateral side, and a second lateral side opposite the first lateral side. The first lateral side defines a first edge. The paint edger also includes an ejection mechanism supported by the frame. The ejection mechanism includes an actuator and defines a second edge. The paint applicator assembly also includes a paint applicator pad having a first connector and a second connector. The first connector is coupled to the first edge of the paint edger and the second connector is coupled to the second edge of the paint edger. The actuator is moveable from a first position, in which the second edge supports the second connector, and a second position, in which the second edge releases the second connector.

In another embodiment the invention provides a paint edger for applying paint with a paint applicator pad that is coupled to the paint edger. The paint edger including a frame with a base having a forward side, a rear side, a first lateral side, and a second lateral side opposite the first lateral side. The base defines a plane that transverses the forward side, the rear side, the first lateral side, and the second lateral side. The paint edger also includes an ejection mechanism with an actuator that extends from the frame. The actuator is moveable in a direction parallel to the plane to uncouple the paint applicator from the paint edger.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
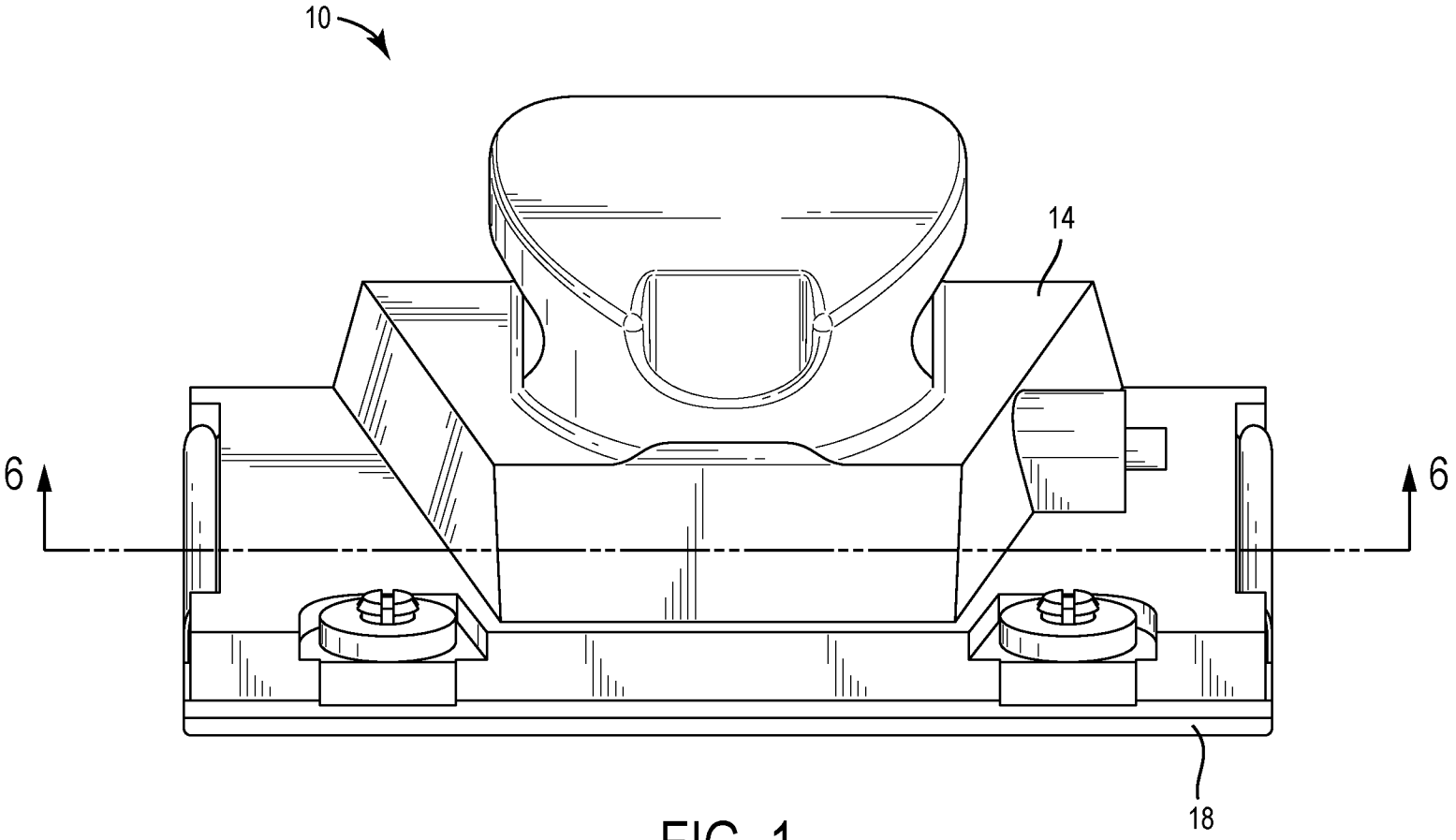
FIG. 1 is a front view of a paint applicator assembly.

FIG. 1 illustrates a paint applicator assembly 10 including a paint edger 14 and an applicator pad 18 for applying a liquid (e.g., paint, primer, stain, etc.) to a surface, such as an interior wall of a building. The illustrated paint applicator assembly 10 is particularly suited for painting corners, borders around windows or doorways, and between adjacent walls.

Figure 2:
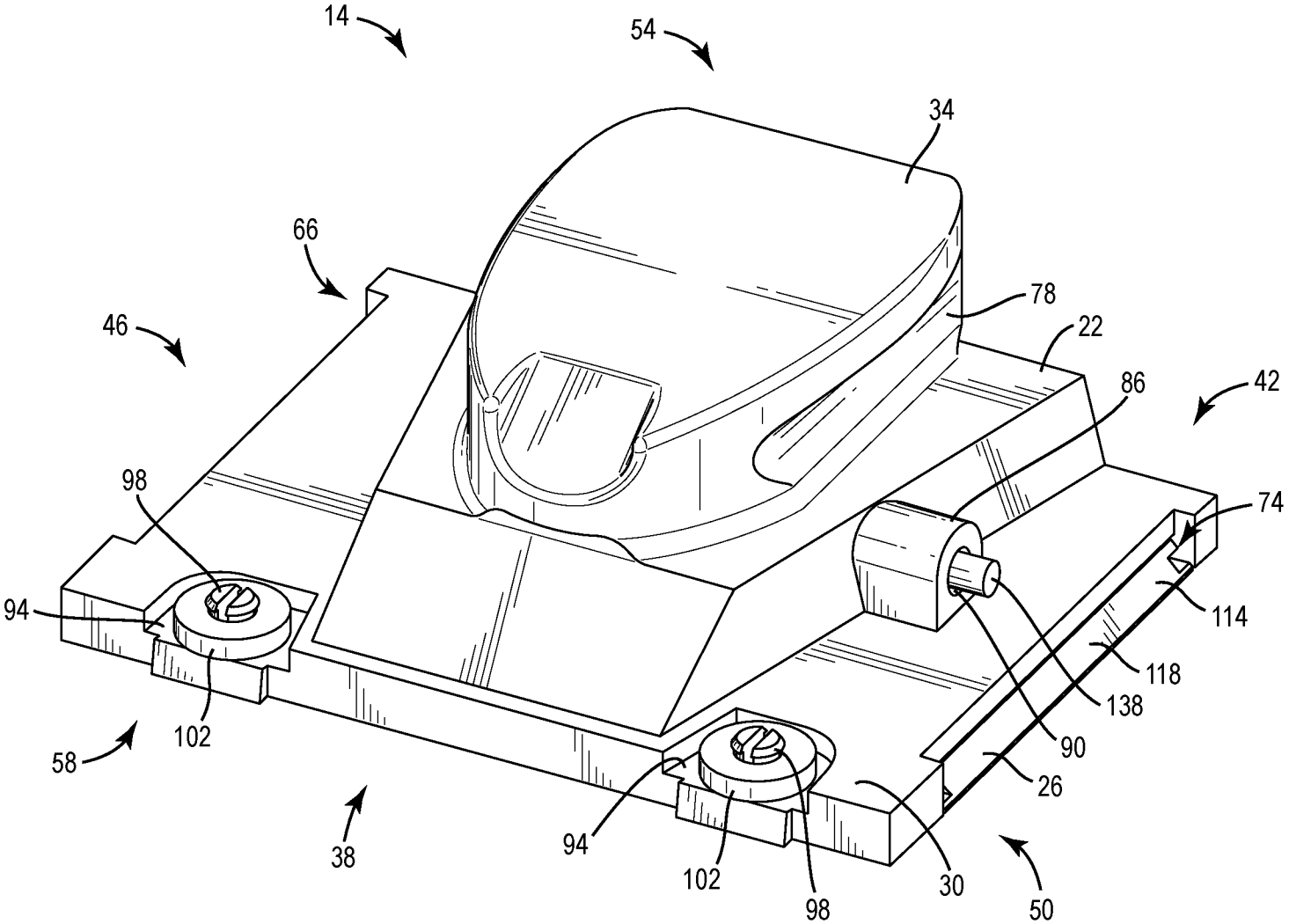
FIG. 2 is a front perspective view of a paint edger of the paint applicator assembly of FIG. 1.
Figure 3:
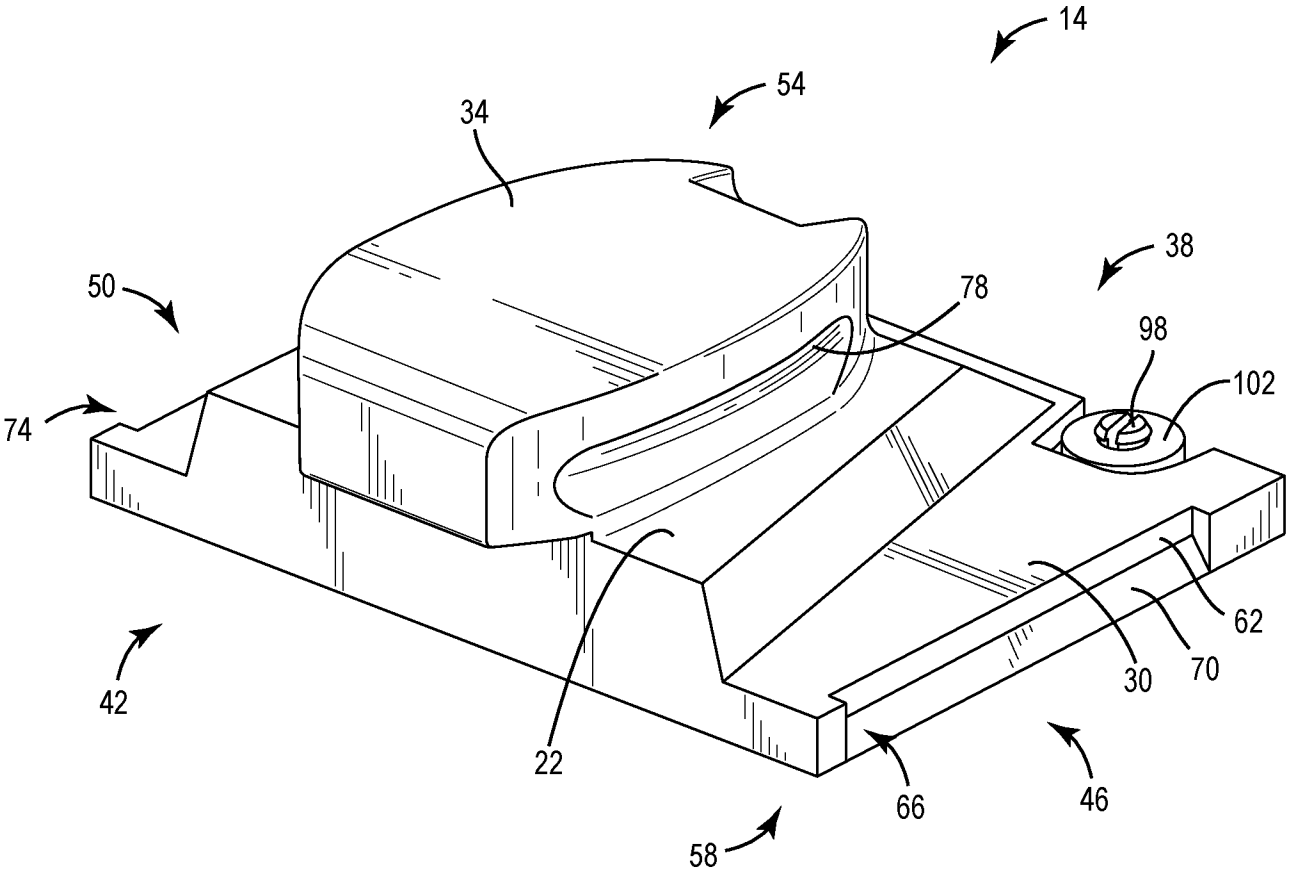
FIG. 3 is a rear perspective view of the paint edger of FIG. 2.

With reference to FIGS. 2 and 3, the paint edger 14 includes a frame 22 and an ejection mechanism 26. The frame 22 is a molded body that may be made by, for example, plastic injection molding. The frame 22 includes a base 30 and a turret 34. In the illustrated embodiment, the base 30 is generally rectangular in shape. In other embodiments, the base 30 may exhibit shapes other than rectangular such as, triangular, hexagonal, and T-shaped. The base 30 includes a forward side 38, a rear side 42, a first lateral side 46, a second lateral side 50 opposite the first lateral side 46, a top side 54, and a bottom side 58 opposite the top side 54. The base 30 defines a plane 60 that transverses the forward side 38, the rear side 42, the first lateral side 46, and the second lateral side 50. The plane 60 defines an area where the paint applicator pad 18 is coupled to the paint edger 14. The first lateral side 46 defines a first lateral recess 66. The first lateral recess 66 is defined by a first edge 62 having an inclined surface 70. The applicator pad 18 engages the first edge 62 when the applicator pad 18 is coupled to the paint edger 14. The second lateral side 50 defines a second lateral recess 74. The ejection mechanism 26 is partially positioned within the second lateral recess 74.

The turret 34 extends from the top side 54 of the base 30 and may be grasped by the hand of a user to increase the control during a painting operation. The turret 34 includes indents 78 to improve the ergonomic grip for a user. The turret 34 and the base 30 define an interior 82 (FIG. 5) of the frame 22. The ejection mechanism 26 is partially positioned within the interior 82. A boss 86 extends from the turret 34 adjacent the second lateral side 50. The boss 86 includes an opening 90 through which a portion of the ejection mechanism 26 extends.

The base 30 of the frame 22 includes recessed surfaces 94 adjacent the forward side 38. A cylindrical projection 98 extends from each of the recessed surfaces 94 for a wheel 102 to be rotationally mounted to. In the illustrated embodiment, the paint edger 14 includes two wheels 102 (i.e., one wheel 102 per projection 98). When the wheels 102 are mounted to the projection 98, a circumferential edge of the wheel 102 extends outward slightly beyond the forward side 38. The slight extension of the wheels 102 backsets the forward side 38 of the base 30 and inhibits the forward side 38 from contacting an adjacent wall. Additionally, the wheels 102 allow the paint applicator assembly 10 to transverse across a painting surface smoothly.

Figure 4:
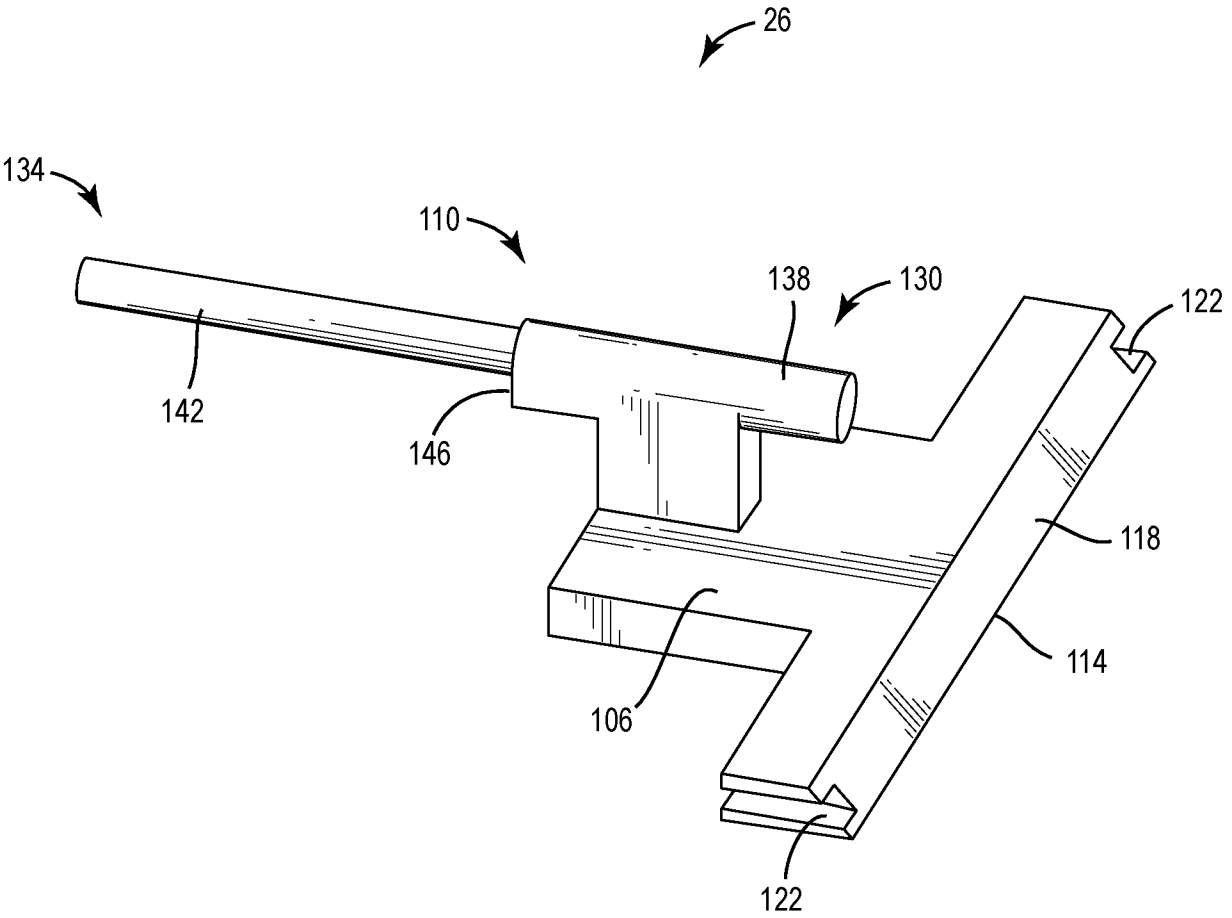
FIG. 4 is a perspective view of an ejection mechanism of the paint edger of FIG. 2.

With reference to FIG. 4, the ejection mechanism 26 includes a base 106 and an actuator 110 extending from the base 106. In the illustrated embodiment, the ejection mechanism 26 is integrally formed as a single component. In other embodiments, the base 106 and the actuator 110 may be separate components. The base 106 includes an edge 114 that is positioned within the second lateral recess 74 of the frame 22. The edge 114 defines an inclined surface 118 that the applicator pad 18 engages when the applicator pad 18 is coupled to the paint edger 14. The edge 114 further includes side grooves 122 on opposite sides of the edge 114. The side grooves 122 receive rails 126 (FIG. 5) on the interior 82 of the frame 22. The rails 126 assist in supporting and guiding the ejection mechanism 26 on the frame 22.

The actuator 110 includes a first end 130 and a second end 134 opposite the first end 130. The first end 130 defines a projection 138 that extends out of the opening 90 of the boss 86. In some embodiments, the projection 138 of the actuator 110 may be referred to as a push-button ejector. In other embodiments, the projection 138 of the actuator 110 may be other types of actuators. The second end 134 defines a shaft 142 of the actuator 110 that extends within the interior 82 of the frame 22. The projection 138 and the shaft 142 of the actuator 110 are generally cylindrical, with the projection 138 having a greater diameter than the shaft 142. As such, the projection 138 defines an abutment 146, or shoulder, where the shaft 142 transitions to the projection 138. In some embodiments, projection 138 and/or the shaft 142 may be differently shaped, such as, triangular or rectangular.

Figure 5:
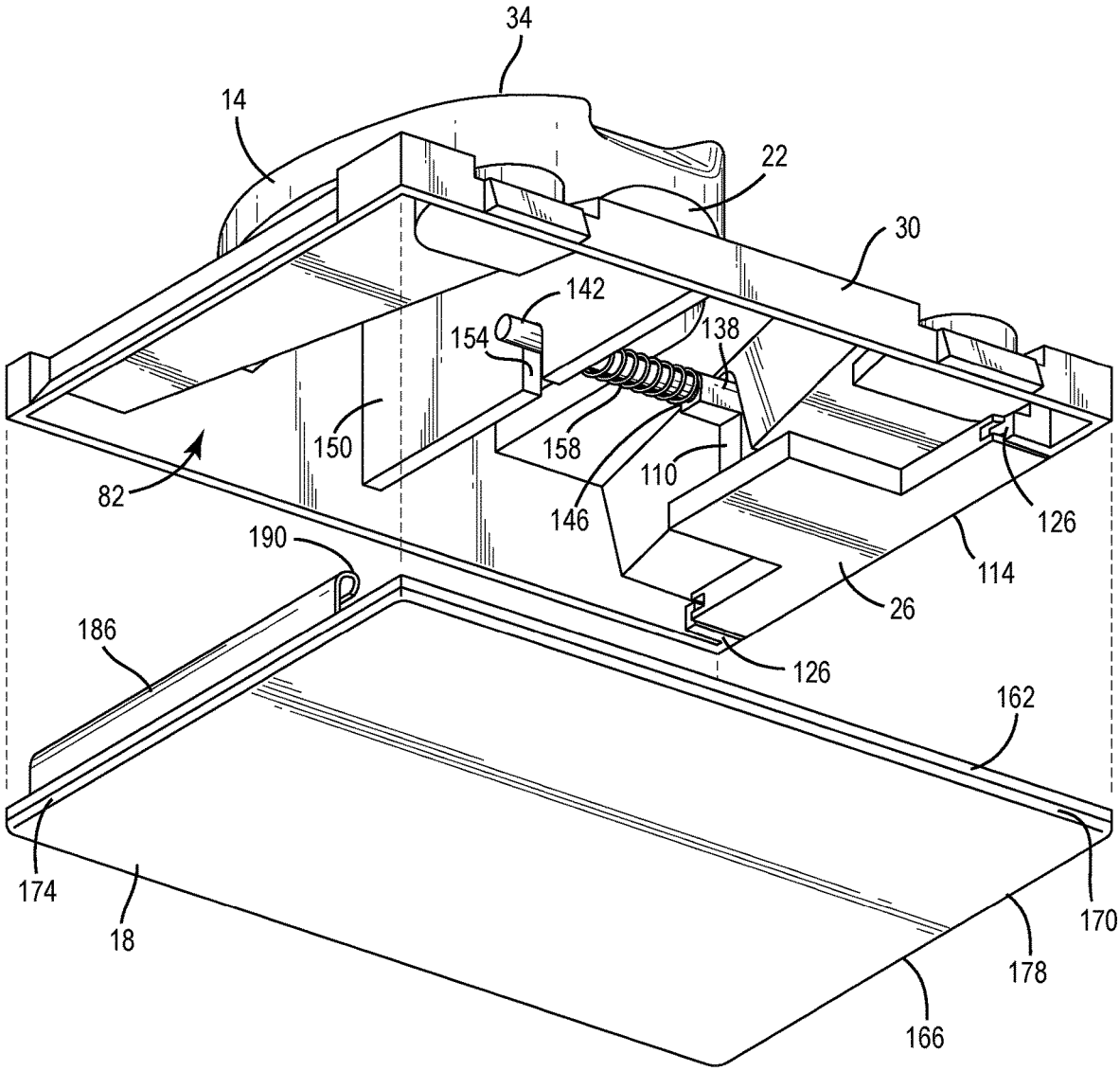
FIG. 5 is a bottom perspective view of the paint applicator assembly of FIG. 1 with an applicator pad detached.

With reference to FIG. 5, the frame 22 includes an interior wall 150 extending from the turret 34 within the interior 82. The interior wall 150 includes a slot 154 that the shaft 142 of the actuator 110 extends into to help align the ejection mechanism 26. A spring 158 is supported on the shaft 142 of the actuator 110 between the abutment 146 of the projection 138 and the wall 150. In the illustrated embodiment, the spring 158 is a coil spring that is wrapped around the shaft 142. In other embodiments, the spring 158 may include other types of resilient members. The spring 158 biases the ejection mechanism 26 to a first position (FIG. 6) so that the actuator 110 extends out of the opening 90 of the boss 86 and the edge 114 of the ejection mechanism 26 is positioned within the second lateral recess 74.

Figure 7:
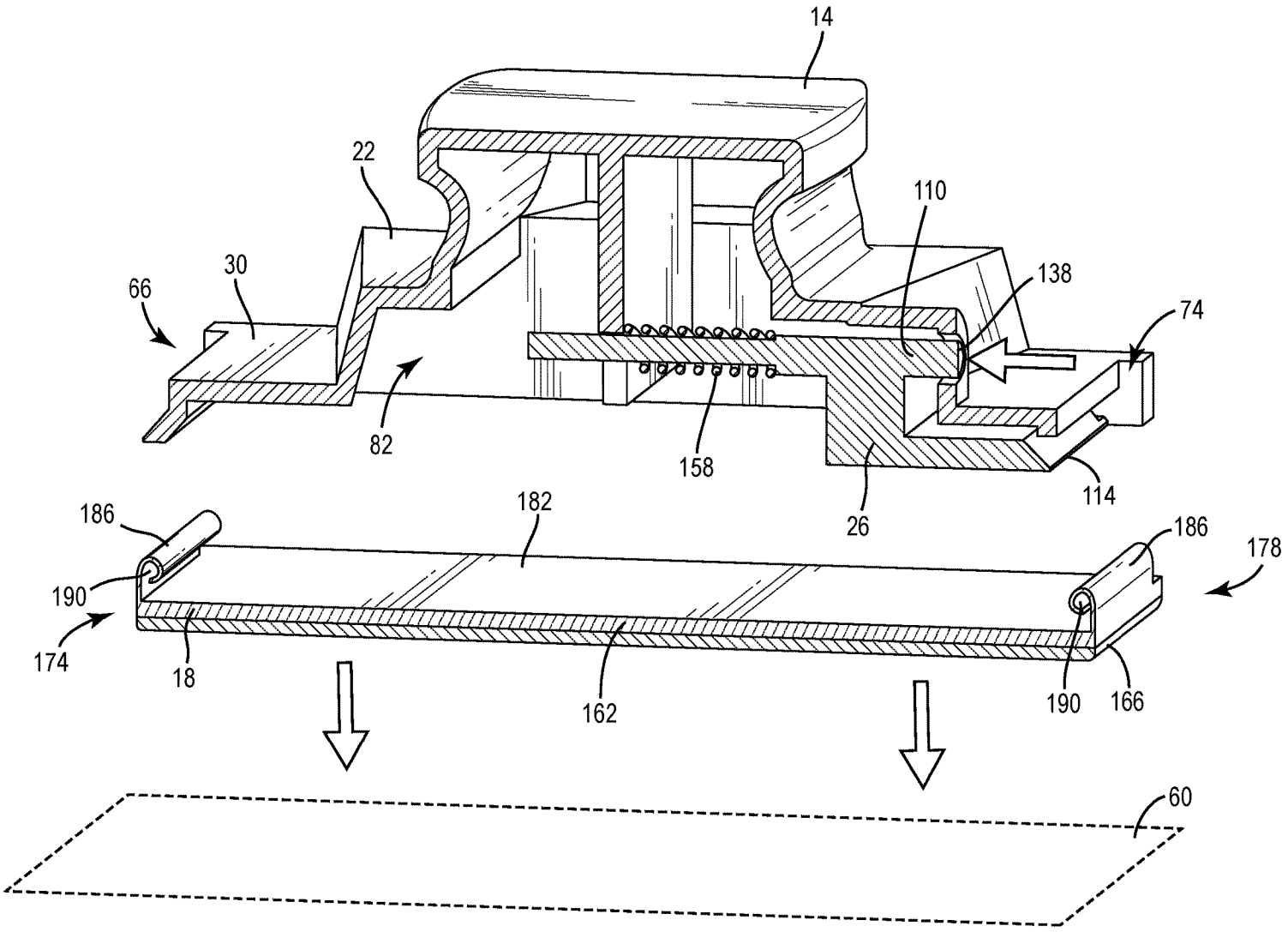
FIG. 7 is a cross-sectional view of the paint applicator assembly of FIG. 6 with the ejection mechanism in a second position and the applicator pad detached.

With continued reference to FIG. 5, the applicator pad 18 is removably coupled to the paint edger 14 to dispose of and replace with a new applicator pad. The applicator pad 18 includes a rigid backing 162 and a fabric patch 166 attached to the rigid backing 162. The rigid backing 162 and the fabric patch 166 are generally parallel to the plane 60 defined by the base 30 when the paint applicator pad 18 is coupled to the paint edger 14. The fabric patch 166 includes a plurality of upstanding fibers that are adapted to retain paint until the fabric patch 166 is positioned against a surface to be painted. The rigid backing 162 and the fabric patch 166 define a generally rectangular painting area having a forward linear edge 170 and opposed lateral edges 174, 178 that are perpendicular to the forward linear edge 170. In the illustrated embodiment, the shape of the base 30 of the frame 22 and the shape of the backing 162 and the shape of the fabric patch 166 are generally the same. In other embodiments, the shape of the base 30 of the frame 22 may differ from the shape of the backing 162 and the fabric patch 166. In further embodiments, the backing 162 and the fabric patch 166 may exhibit shapes other than rectangular, such as, triangular, hexagonal, and T-shaped. A back surface 182 of the backing 162 includes a pair of connectors 186 longitudinally extending approximate the lateral edges 174, 178 (FIG. 7). In the illustrated embodiment, each connector 186 includes an upstanding loop. In other embodiments, the connectors 186 may take other suitable forms. Each connector 186 cooperates with the back surface 182 to define a longitudinally extending groove 190. As will be discussed in more detail below, the grooves 190 operate to couple the applicator pad 18 to the paint edger 14.

Figure 6:
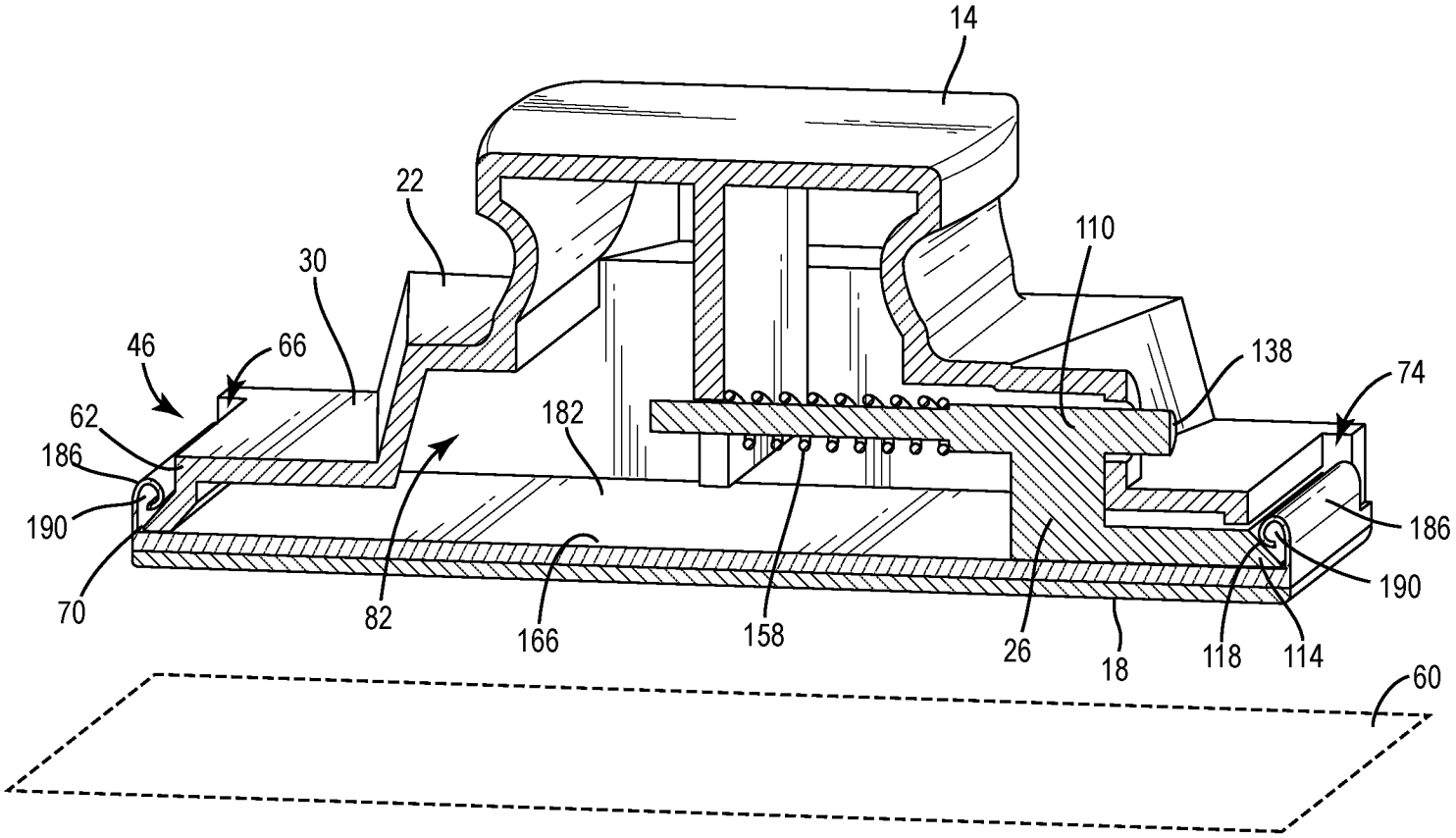
FIG. 6 is a cross-sectional view of the paint applicator assembly of FIG. 1 taken along line 6-6 with the ejection mechanism in a first position.

Referring to FIGS. 6 and 7, as mentioned above, the applicator pad 18 is removably coupled to the paint edger 14. To couple the applicator pad 18 to the paint edger 14, a user may align the applicator pad 18 under the paint edger 14 so that one of the connectors 186 is aligned with the first lateral recess 66 and the other connector 186 is aligned with the edge 114 of the ejection mechanism 26. Initially, each connector 186 of the backing 162 is vertically oriented with respect to the first and second lateral recess 66, 74. When this orientation is reached, the user may bring the paint edger 14 vertically closer to the applicator pad 18. As the paint edger 14 nears the applicator pad 18, the edge 62 of the first lateral side 46 and/or the edge 114 of the ejection mechanism 26 may deform (e.g., deflect) one or both of the connectors 186 outward and away from each other. With the connectors 186 deformed, the grooves 190 are exposed. When the grooves 190 are adjacent with the inclined surfaces 70, 118, the connectors 186 move inwards to retain the applicator pad 18 on the inclined surfaces 70, 118. In some embodiments, the inclined surfaces 70, 118 may include an edge that extends beyond the first and second lateral sides 46, 50 that is retained inside the grooves 190 to further secure the applicator pad 18 to the paint edger 14.

To remove the applicator pad 18 from the paint edger 14, a user may move the ejection mechanism 26 from the first or engaged position (FIG. 6) to a second or release position (FIG. 7). A user may move the ejection mechanism 26 from the first position to the second position by pressing the projection 138 of the actuator 110 into the interior 82 of the frame 22. By pressing the projection 138 of the actuator 110, the ejection mechanism 26 is slid linearly against the bias of the spring 158 in a direction parallel to the plane 60 defined by the base 30 and the back surface 182 of the backing 162 of the applicator pad 18. Meanwhile, the edge 114 of the ejection mechanism 26 moves in a direction parallel to the back surface 182 of the applicator pad 18 away from one of the connectors 186. As the edge 114 is moved inward away from the connector 186, the inclined surface 118 disengages the groove 190, allowing the applicator pad 18 to separate from the paint edger 14. Once the applicator pad 18 is separated from the paint edger 14, the applicator pad 18 may fall away from the paint edger 14 and a new applicator pad may be coupled to the paint edger 14 as described above. Such an arrangement facilitates removing the applicator pad 18 from the paint edger 14 without having to touch the applicator pad 18 (and, thereby, leftover paint on the applicator pad 18).

In some situations, the applicator pad 18 may also be connected to the paint edger 14 by using the ejection mechanism 26. For example, rather than deflecting one or both of the connectors 186, the connector 186 adjacent the first lateral recess 66 may first be hooked around the inclined surface 70. Then, the projection 138 of the actuator 110 may be depressed to retract the edge 114 of the ejection mechanism 26. The other connector 186 is moved into the second lateral recess 74 and the actuator 110 is released, allowing the spring 158 to bias the edge 114 outward to engage the other connector 186.

Figure 8:
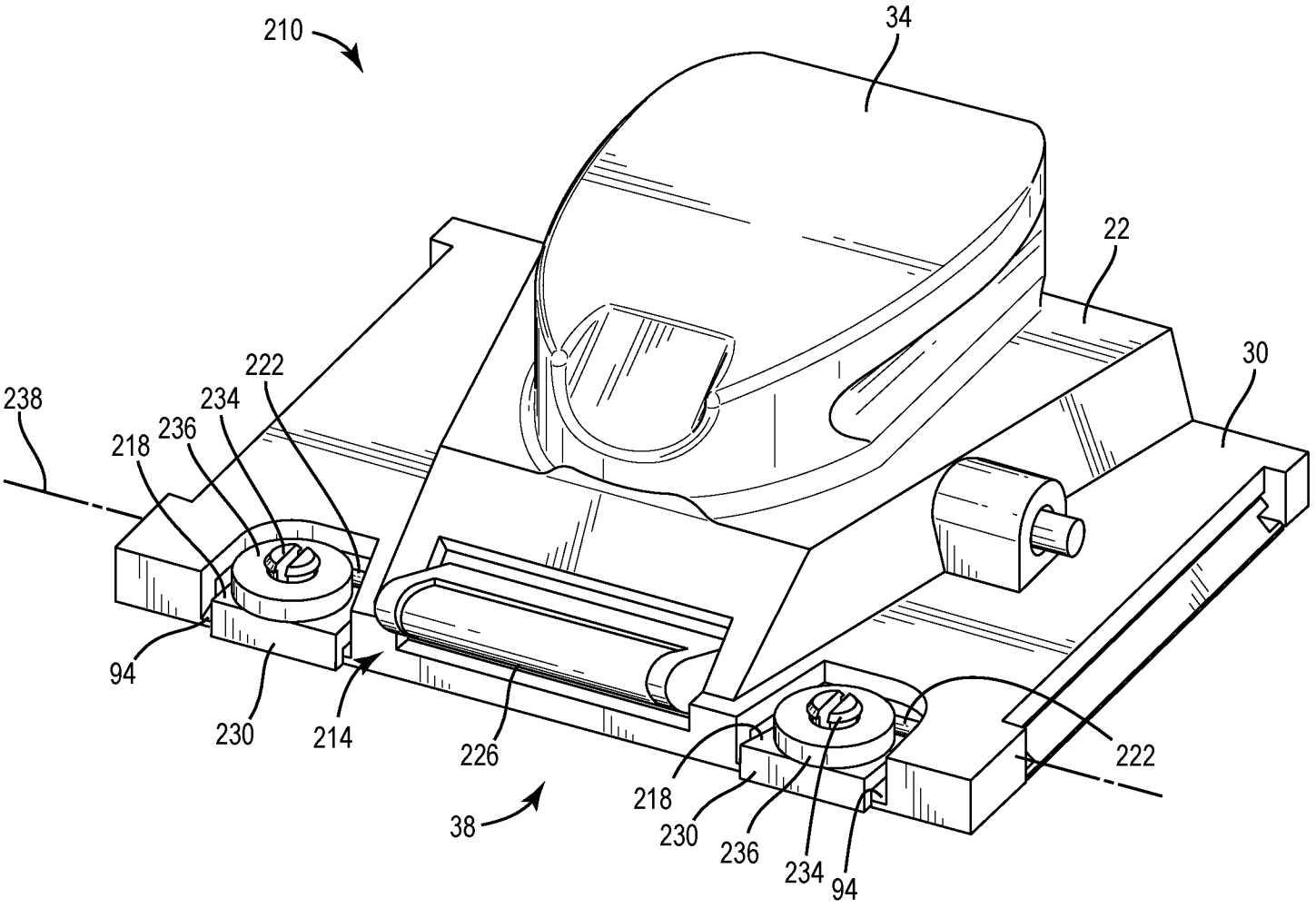
FIG. 8 is a paint edger for use with the paint applicator assembly of FIG. 1 according to another embodiment of the invention.

FIG. 8 illustrates a paint edger 210 according to another embodiment of the invention. The paint edger 210 is similar to the paint edger 14 described above, with like features being represented with like reference numerals.

The paint edger 210 includes an adjustable guide assembly 214 adjacent the forward side 38 of the paint edger 210. The guide assembly 214 includes a pair of bases 218, a tubular connector 222 extending between the bases 218, and a lever 226. The bases 218 are respectively positioned in one of the recessed surfaces 94 of the base 30 of the frame 22. Each base 218 includes a straight edge 230 that cooperates to from a generally L-shaped feature that extends partially over the forward side 38. Each base 218 also includes a projection 234 similar to the projections 98 discussed above that each retain a wheel 236 that is rotatable about the projection 234. The wheels 236 partially extend past the forward side 38 and the straight edge 230 to contact a wall or other edge being painted. The connector 222 is coupled to both the bases 218 and extends partially through the interior 82 of the frame 22. The lever 226 extends from a central portion of the connector 222 and is movable to rotate the connector 222 about an axis 238 that extends centrally through the connector 222.

The guide assembly 214 is repositionable between an extended position and a retracted position by rotating the lever 226 about the axis 238. Moving the lever 226 towards the turret 34 to the retracted position positions the wheels 234 so that a portion of the wheels 234 does not extend (or only barely extends) past the forward side 38 of the frame 22. The extended position may correspond to a painting configuration where the paint edger 210 is used to paint a surface. The retracted position may correspond to a paint loading configuration where the guide assembly 214 is moved out of potential contact with a reservoir of paint as an applicator pad is dipped in the reservoir.

Various features and advantages of the invention are set forth in the following claims.

What is claimed is:

1. A paint edger for applying paint with a paint applicator pad that is coupled to the paint edger, the paint edger comprising:

a frame including a base having a forward side, a rear side, a first lateral side, and a second lateral side opposite the first lateral side, the first lateral side defines a first edge; and an ejection mechanism supported by the frame, the ejection mechanism including a base positioned at least partially within an interior of the frame and a second edge adjacent the second lateral side of the base of the frame and an actuator coupled to the base of the ejection mechanism, the actuator including a projection that extends out of the interior of the frame, the actuator operable to move the second edge inwardly relative to the frame from an extended position, in which the second edge supports the paint applicator pad adjacent the second lateral side, to a retracted position, in which the second edge uncouples the paint applicator pad from the paint edger.

2. The paint edger of claim 1, wherein the actuator and the second edge are integrally formed as a single component.

3. The paint edger of claim 1, wherein the frame includes a turret extending from the base of the frame.

4. The paint edger of claim 3, wherein the actuator is biased to the first position by a spring.

5. The paint edger of claim 1, wherein the base of the frame defines a plane that transverses the forward side, the rear side, the first lateral side, and the second lateral side, and wherein the actuator is moveable in a direction parallel to the plane to uncouple the paint applicator pad from the paint edger.

6. The paint edger of claim 1, wherein the actuator extends from an opening in the frame.

7. The paint edger of claim 1, wherein the first lateral side defines a first lateral recess that the first edge is positioned within and the second lateral side defines a second lateral recess that the second edge is positioned within.

8. A paint edger for applying paint with a paint applicator pad that is coupled to the paint edger, the paint edger comprising:

a frame including a base having a forward side, a rear side, a first lateral side, and a second lateral side opposite the first lateral side, the base defines a plane that transverses the forward side, the rear side, the first lateral side, and the second lateral side;

an ejection mechanism including an actuator that extends from the frame, the actuator slides linearly in a direction parallel to the plane to uncouple the paint applicator pad from the paint edger;

wherein the ejection mechanism is coupled to the frame by a groove and a rail that guide and support the ejection mechanism as the ejection mechanism slides linearly in the direction parallel to the plane.

9. The paint edger of claim 8, wherein the ejection mechanism defines an edge configured to support the paint applicator pad on the paint edger.

10. The paint edger of claim 9, wherein the actuator is moveable from a first position, in which the second edge supports the paint applicator pad, and a second position, in which the second edge releases the paint applicator pad from the paint edger.

11. The paint edger of claim 8, wherein the actuator includes a first portion that extends from the frame and a second portion that extends within an interior of the frame.

12. The paint edger of claim 11, wherein the first portion of the actuator is generally cylindrical.

13. The paint edger of claim 11, further comprising a spring positioned on the second portion of the actuator to bias the first portion of the actuator out of the frame.

14. The paint edger of claim 8, wherein the actuator is a push-button ejector.

* * * * *